US006564874B2

(12) United States Patent
Narvaez

(10) Patent No.: US 6,564,874 B2
(45) Date of Patent: May 20, 2003

(54) TECHNIQUE FOR FACILITATING THE PUMPING OF FLUIDS BY LOWERING FLUID VISCOSITY

(75) Inventor: Diego Narvaez, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/903,240

(22) Filed: Jul. 11, 2001

(65) Prior Publication Data

US 2003/0010501 A1 Jan. 16, 2003

(51) Int. Cl.[7] ..... E21B 43/00

(52) U.S. Cl. ..... 166/372; 166/62; 166/66.4; 417/423.3

(58) Field of Search ..... 166/302, 60, 61, 166/62, 66.4, 68.5, 372; 417/14, 216, 410.1, 423.3

(56) References Cited

U.S. PATENT DOCUMENTS 3,824,364 A 7/1974 Cachat
3,841,786 A * 10/1974 Florjancic ..... 376/402
4,401,159 A 8/1983 Kofahl
4,790,375 A 12/1988 Bridges et al.
5,285,846 A 2/1994 Mohn
5,554,897 A 9/1996 Martin et al.
5,623,576 A 4/1997 Deans
5,845,709 A * 12/1998 Mack et al. ..... 359/529
6,006,837 A 12/1999 Breit
6,167,965 B1 * 1/2001 Bearden et al. ..... 166/105.5
6,206,093 B1 * 3/2001 Lee et al. ..... 166/60
6,260,627 B1 * 7/2001 Rivas ..... 166/369
6,318,467 B1 * 11/2001 Liu et al. ..... 166/302

* cited by examiner

*Primary Examiner*—William Neuder
*Assistant Examiner*—Robert D Jones
(74) *Attorney, Agent, or Firm*—Fletcher, Yoder & Van Someren; Jeffery E. Griffin; Brigitte L. Jeffery

(57) ABSTRACT

A viscosity handling system for facilitating the movement of certain fluids. The system utilizes kinetic energy in the form of a rapidly and repetitively moving component that imparts energy in the form of heat to surrounding fluid. The system is particularly useful in applications, such as downhole pumping systems, used to produce hydrocarbon-based fluids from beneath the surface of the earth.

28 Claims, 6 Drawing Sheets

TECHNIQUE FOR FACILITATING THE PUMPING OF FLUIDS BY LOWERING FLUID VISCOSITY

FIELD OF THE INVENTION

The present invention relates generally to movement of fluids, such as wellbore fluids, and particularly to a technique for lowering the viscosity of a fluid to permit more efficient production of the fluid.

BACKGROUND OF THE INVENTION

When pumping viscous fluids, the performance of certain pumps, such as centrifugal pumps, is considerably degraded. For example, the pump head and rate of production are decreased while the horsepower requirement increases drastically. This leads to substantially reduced efficiency of the pump. In certain pumping applications, such as in the production of oil, this low efficiency can add considerably to the cost of oil production or even inhibit the ability to produce from the region.

Attempts have been made to lower the fluid viscosity prior to pumping. For example, electric heaters have been used in combination with electric submersible pumping systems to heat the oil prior to being drawn into the submersible pump of the overall system. With electric heaters, however, electricity must be supplied downhole by, for example, a power cable. Other attempts to lower viscosity have included the injection of relatively hot vapor or the use of downhole combustion to generate heat. Each of these approaches can add undesirable cost and complexity depending on the particular environment and application.

SUMMARY OF THE INVENTION

The present invention relates generally to a technique for lowering the viscosity of a fluid prior to pumping the fluid. The technique is particularly amenable for use in a downhole environment for the production of oil. The viscous fluid is passed through a viscosity handler prior to being drawn into the production pump which moves a desired fluid from one location to another. The viscosity handler utilizes a movable component that is rapidly and repetitively moved through the fluid. Part of this kinetic energy is translated to the surrounding oil in the form of heat. The heat, in turn, lowers the viscosity of the fluid to permit more efficient production of the fluid by the production pump.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

Figure 1:
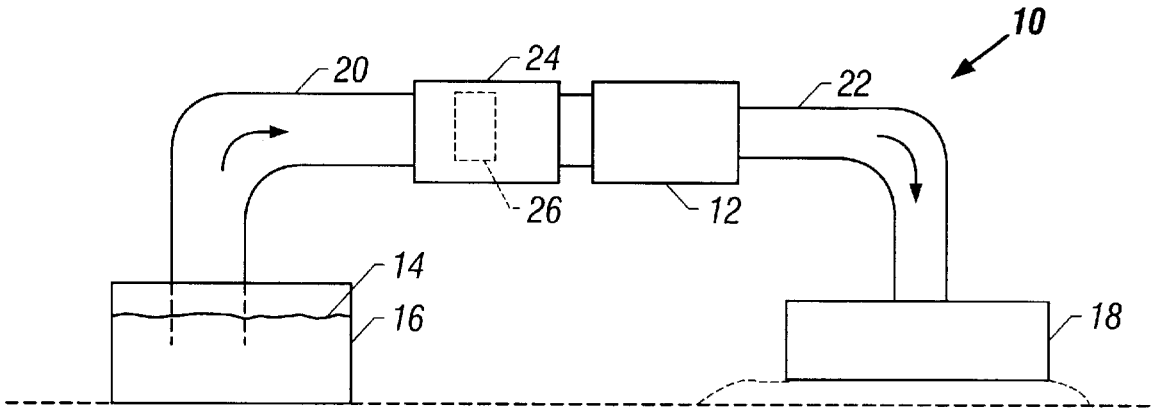
FIG. 1 is a front elevational view of an exemplary pumping system, according to one embodiment of the present invention.

Referring generally to FIG. 1, a system 10 for facilitating the movement of a viscous fluid is illustrated. Generally, system 10 comprises a production pump 12 that produces a fluid 14 from a reservoir 16 to a desired location, such as holding tank 18. Production pump 12 draws fluid 14 along an intake pathway 20 and discharges the fluid along an outflow pathway 22 to tank 18. A viscosity handler 24 is disposed upstream from production pump 12 and is utilized to lower the viscosity of fluid 14 prior to entering the production pump.

Viscosity handler 24 is designed as an energy translator in which kinetic energy is transferred to fluid 14 in the form of heat. The heat energy lowers the viscosity of fluid 14 to promote better efficiency and greater production from production pump 12. Viscosity handler 24 comprises a movable component 26 that rapidly and repetitively moves through fluid 14 as it flows through viscosity handler 24 to production pump 12. For example, movable component 26 may be a rotatable component rotated through fluid 14. In this example, the rotation of movable component 26 is the action that causes fluid 14 to rise in temperature, consequently lowering its viscosity.

Figure 2:
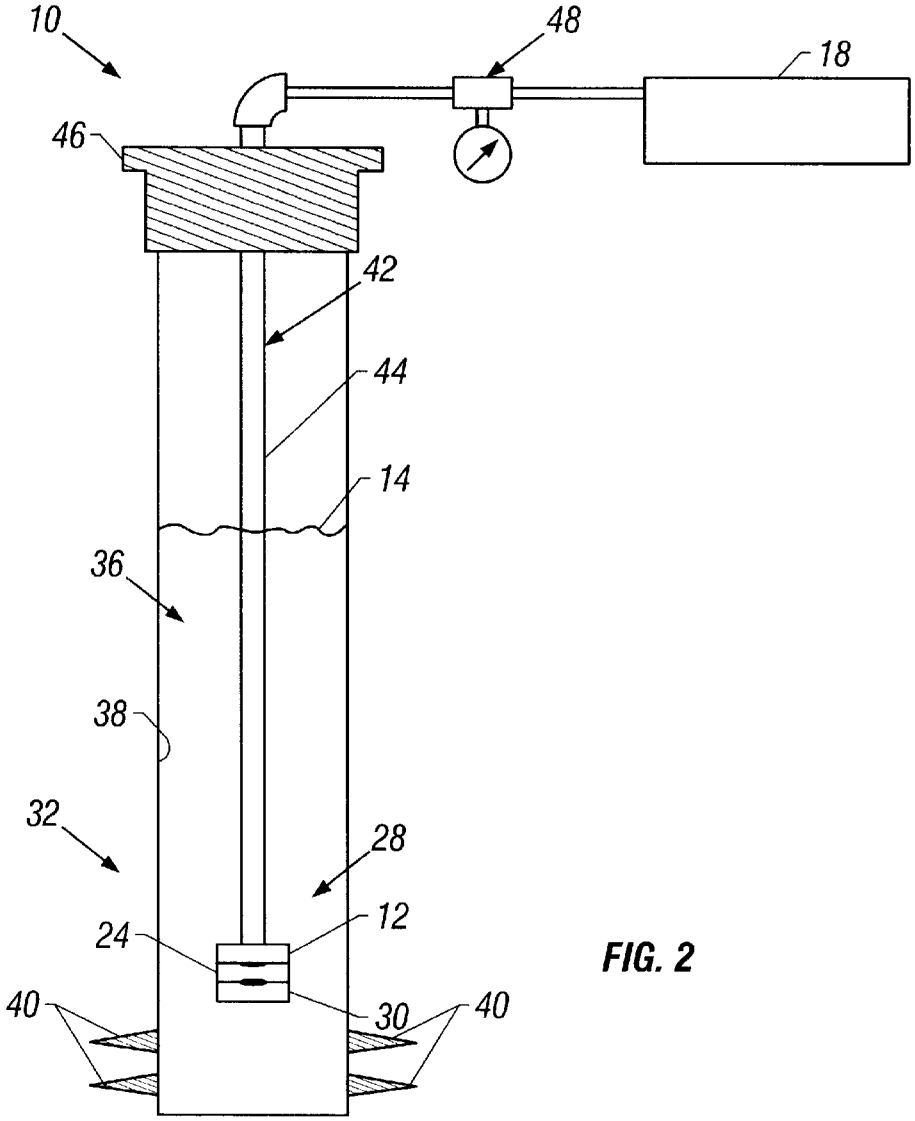
FIG. 2 is a front elevational view of an exemplary pumping system disposed within a wellbore.

An exemplary application of system 10 is illustrated in FIG. 2. In this application, an electric submersible pumping system 28 utilizes production pump 12 and viscosity handler 24. Typically, production pump 12 and viscosity handler 24 are powered by a submersible motor 30. Also, a variety of other components may be utilized as part of electric submersible pumping system 28 as known to those of ordinary skill in the art.

System 28 is designed for deployment in a well 32 within a geological formation containing fluid 14, typically a desirable production fluid such as petroleum. In this application, a wellbore 36 is drilled and lined with a wellbore casing 38. Fluid passes through wellbore casing 38 into wellbore 36 through a plurality of openings 40, often referred to as perforations. Then, the fluid is drawn into electric submersible pumping system 28, the viscosity is lowered by viscosity handler 24, and the lower viscosity fluid is discharged to a desired location, such as holding tank 18.

System 28 is deployed in wellbore 36 by a deployment system 42 that may have a variety of forms and configurations. For example, deployment system 42 may comprise tubing 44 through which fluid 14 is discharged as it flows from electric submersible pumping system 28 through a wellhead 46 to a desired location. Various flow control and pressure control devices 48 may be utilized along the flow path.

Figure 3:
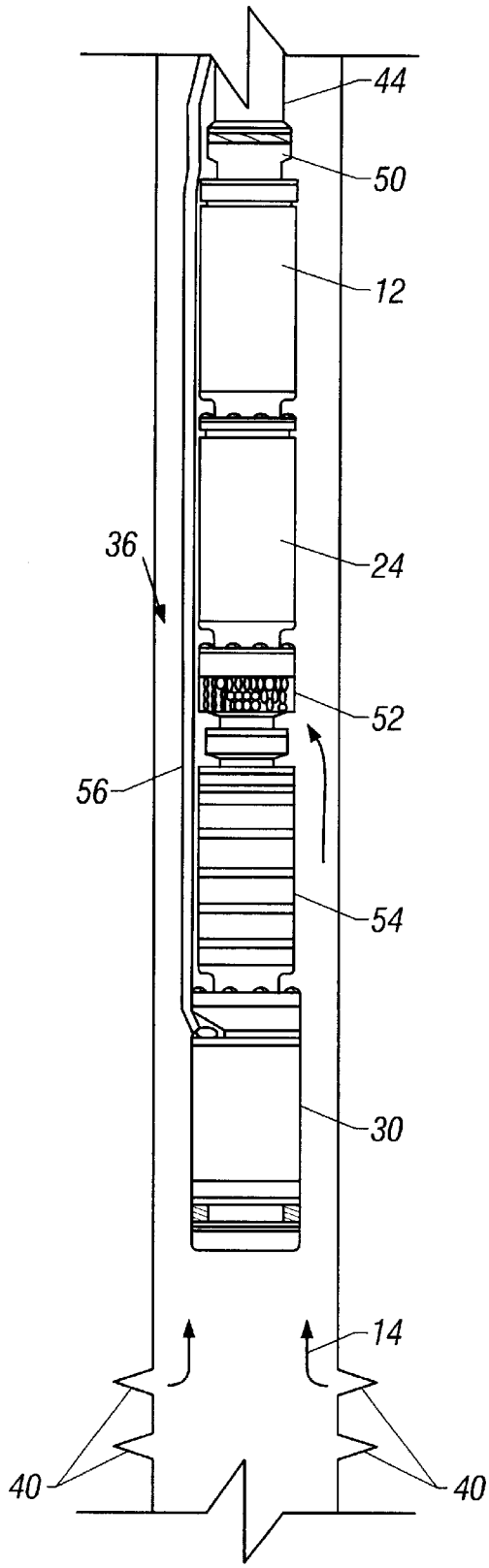
FIG. 3 is a front elevational view of an exemplary electric submersible pumping system that may be used to pump fluids within a wellbore.

A more detailed illustration of electric submersible pumping system 28 is provided in FIG. 3. In this embodiment, tubing 44 is coupled directly to production pump 12 by a connector 50. Viscosity handler 24 is coupled to production pump 12 on an end opposite connector 50. A fluid intake 52 is mounted to viscosity handler 24 at an upstream end to draw fluid 14 into viscosity handler 24 from wellbore 36. Submersible motor 30 is mounted below fluid intake 52 and typically is coupled to a motor protector 54. Furthermore, submersible motor 30 receives electrical power via a power cable 56.

In the example illustrated, submersible motor 30 is deployed between perforations 40 and fluid intake 52. Thus, as fluid is drawn into wellbore 36 through perforations 40, it passes submersible motor 30 to fluid intake 52. Heat generated by motor 30 is used to begin lowering the viscosity of fluid 14 prior to entering viscosity handler 24.

Figure 4:
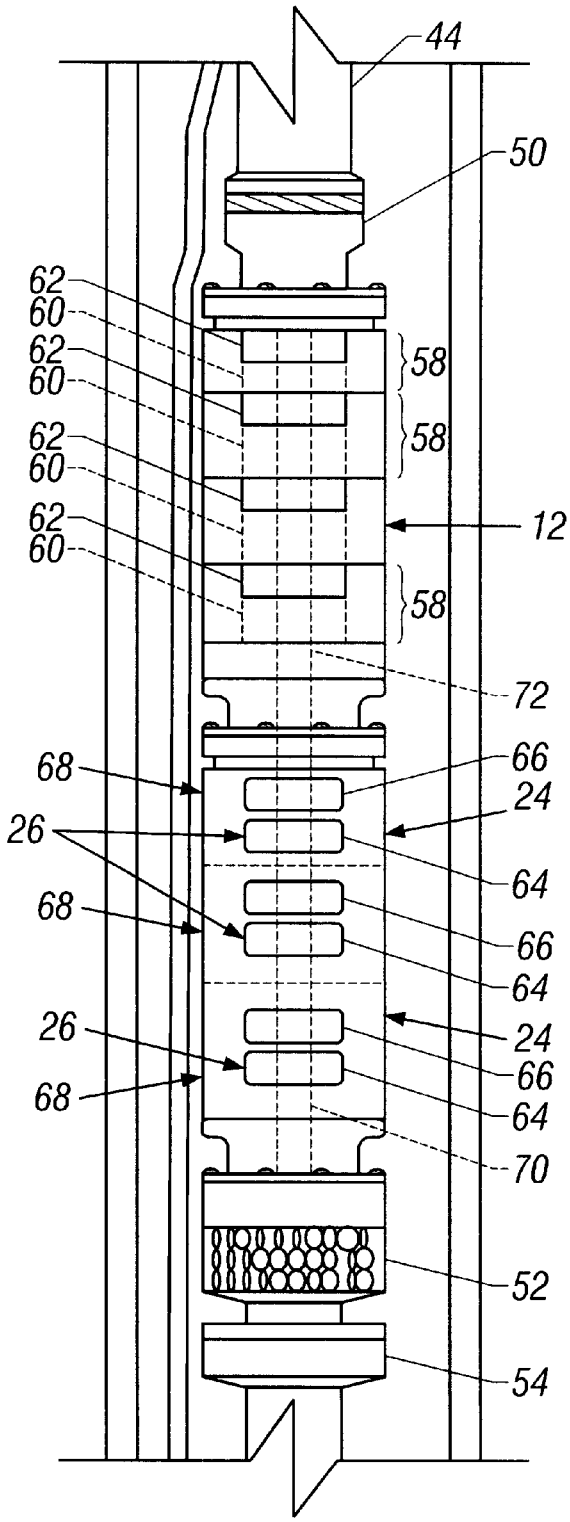
FIG. 4 is an enlarged view of the production pump and viscosity handler illustrated in FIG. 3.

Referring generally to FIG. 4, an exemplary combination of viscosity handler 24 and production pump 12 is illustrated. In this embodiment, production pump 12 is a centrifugal pump having a plurality of stages 58. Each stage includes an impeller 60 and a diffuser 62. The impellers 60 drive fluid upwardly through subsequent diffusers and impellers until the fluid is produced or discharged through connector 50 and tubing 44.

In this exemplary application, movable component 26 of viscosity handler 24 comprises a plurality of rotatable members 64, such as impellers. The movable members 64 are separated by a plurality of diffusers 66 to form multiple stages 68. Movable members 64 cooperate to translate substantial kinetic energy into heat energy within the fluid passing therethrough. The power for imparting kinetic energy to movable members 64 as well as for powering production pump 12 is provided by submersible motor 30 via a shaft or shaft sections 70 and 72 to which movable member 64 and impellers 60, respectively, are mounted.

With the particular design illustrated in FIG. 4, movable members 64 and diffusers 66 cooperate to allow fluid movement from intake 52 to production pump 12. Members 64 may even be configured to facilitate movement of fluid through the viscosity handler. For example, viscosity handler 24 may be designed as a poor efficiency pump able to produce a temperature rise in the fluid and therefore a lower viscosity fluid for production by production pump 12. In this manner, the use of a low efficiency device promotes higher efficiency of the overall system and allows an application engineer to select a production pump able to produce at a relatively high rate with great efficiency.

Figure 5:
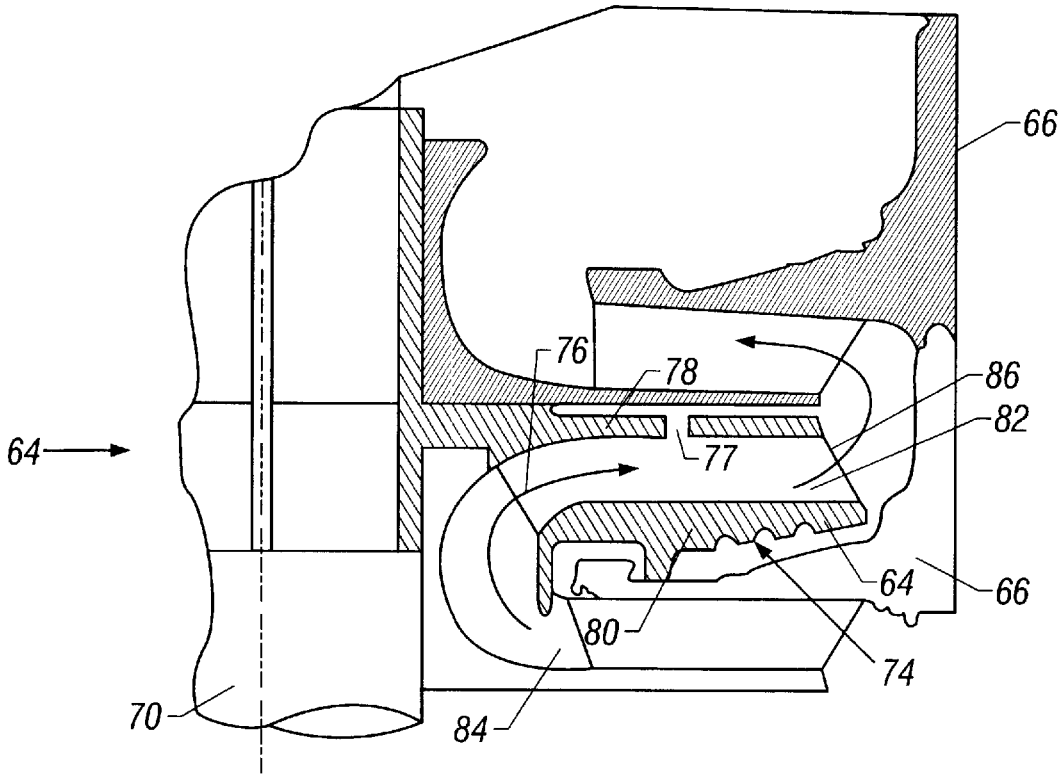
FIG. 5 is an enlarged cross-sectional view of a radial flow type impeller that may be utilized within the viscosity handler illustrated in FIG. 4.

In the embodiment illustrated, the impellers 60 of production pump 12 comprise mixed flow impellers, but may be radial flow impellers in certain lower flow applications. Mixed flow impellers are beneficial in many environments because of their ability to produce a relatively high flow rate with great efficiency. However, the fluid being produced must have sufficiently low viscosity or the performance curve of the production pump is greatly degraded and may render electric submersible pumping system 28 incapable of production. Accordingly, if impellers are utilized as rotating members in viscosity handler 24, it is desirable to utilize low efficiency impellers, such as radial flow impellers. Exemplary embodiments of a radial flow impeller and a mixed flow impeller are illustrated in FIGS. 5 and 6, respectively.

In the radial flow design, movable member/impeller 64 is rotationally affixed to shaft section 70 by, for instance, a key (not shown). The impeller comprises an impeller body 74 with a plurality of vanes 76 disposed generally between an upper wall 78 and a lower wall 80. Walls 78 and 80 as well as vanes 76 define a plurality of flow chambers 82 disposed circumferentially around shaft segment 70. A recirculation hole 77 extends through upper wall 78 and is helpful in heating the fluid. When impeller body 74 is rotated with shaft segment 70, fluid is drawn into the flow chamber 82 through an inlet 84 and discharged radially through a radial outlet 86 into adjacent stationary diffuser 66. The fluid then enters the upper diffuser vanes and is directed through subsequent stages before being drawn into production pump 12. The inefficient, repetitive motion of members 64 through fluid 14 creates heat and lowers the viscosity of fluid 14.

Figure 6:
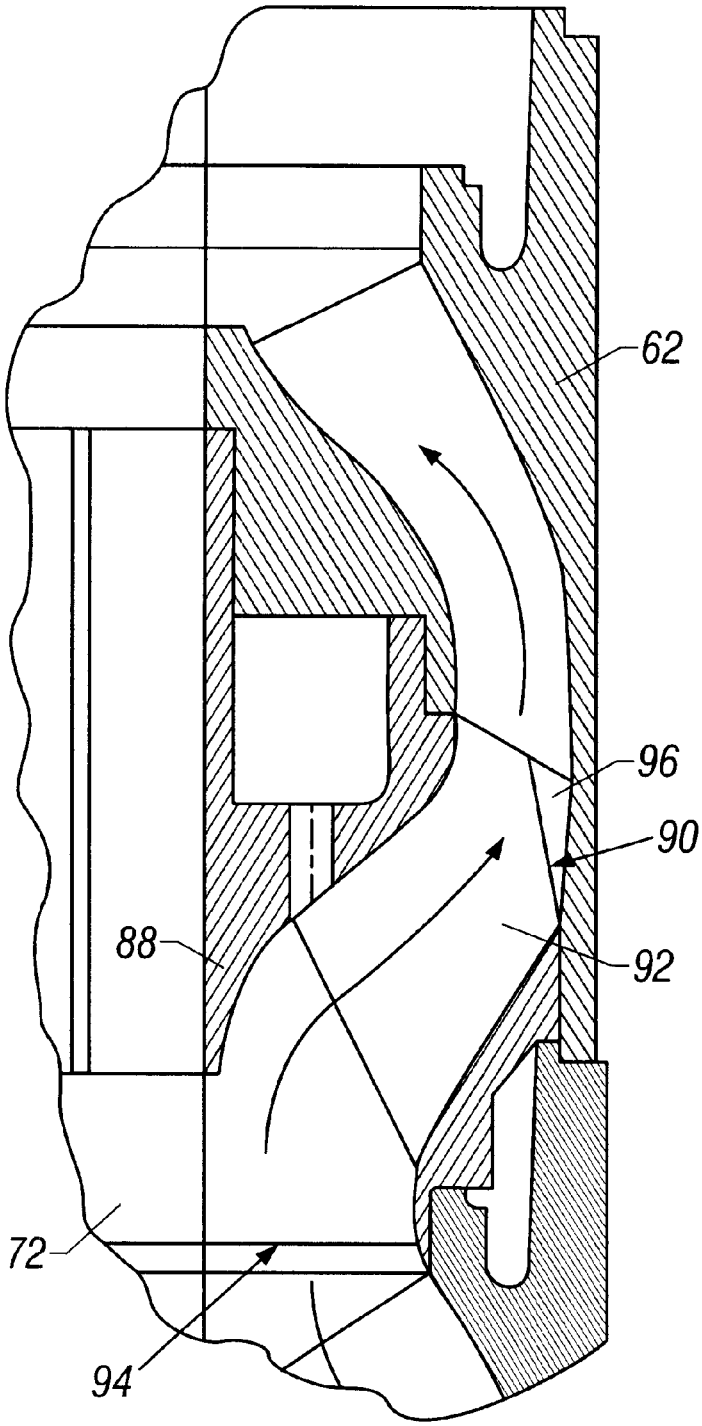
FIG. 6 is an enlarged cross-sectional view of a mixed flow type impeller that may be used with the production pump illustrated in FIG. 4.

In this example, impellers 60 of production pump 12 are mixed flow type impellers, as illustrated best in FIG. 6. A mixed flow impeller body 88 comprises a plurality of angled vanes 90 that are spaced circumferentially about shaft segment 72. Each angled vane 90 defines a flow chamber 92. As impeller body 88 is rotated with shaft segment 72, each angled vane 90 draws fluid in through an inlet 94, and the fluid flows through flow chambers 92 until it is discharged through an impeller outlet 96 to diffuser 62. With mixed flow impellers, the fluid typically is drawn from a lower location through inlet 94 and moved upwardly and outwardly for discharge at a higher location. The fluid is pumped through consecutive impellers and diffusers as it moves through the plurality of stages 58 for discharge through connector 50 and tubing 44. (See FIG. 4).

Figure 7:
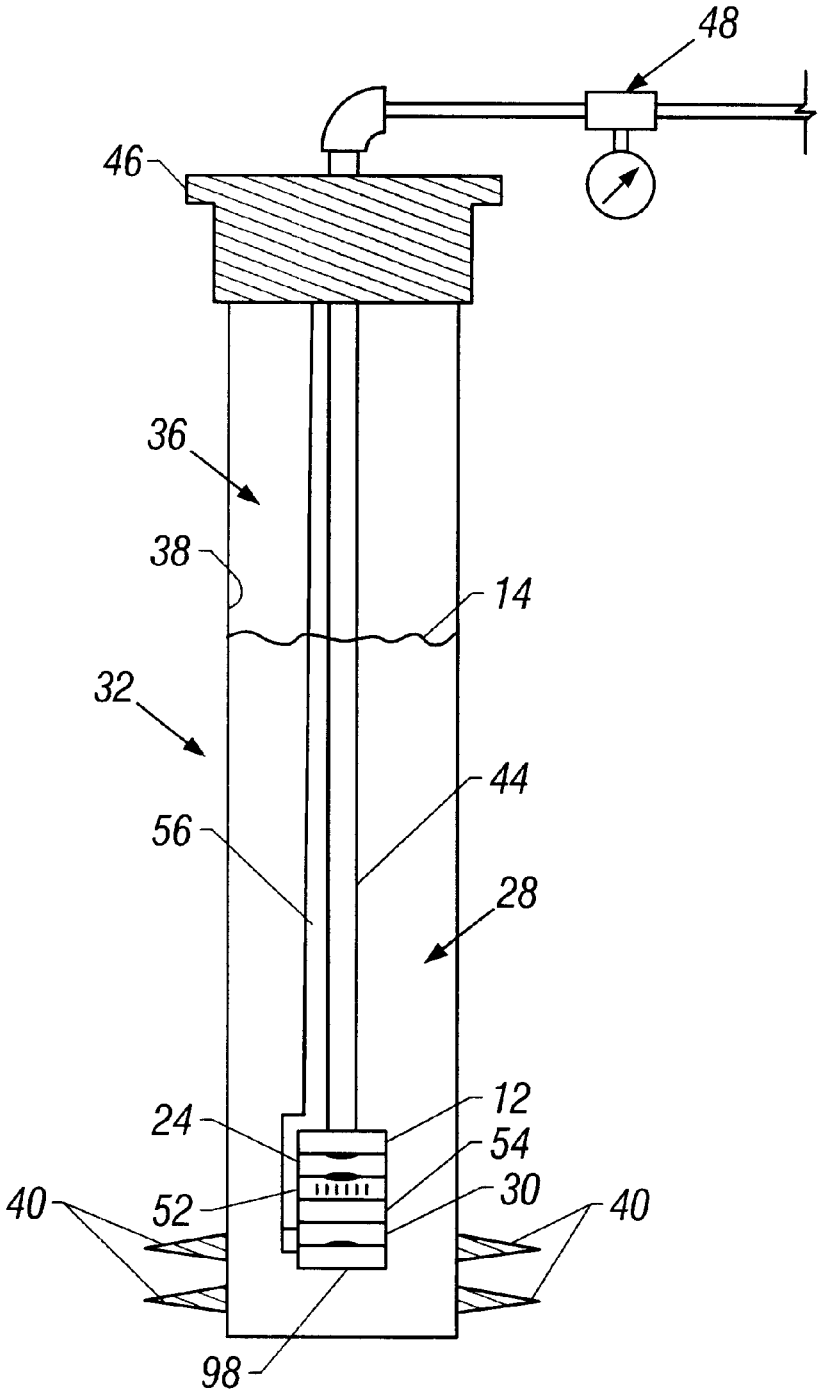
FIG. 7 is a front elevational view of an alternate embodiment of the pumping system disposed in a wellbore.

Viscosity handler 24 may be deployed in a variety of environments and in combination with other components that are used in downhole applications or with electric submersible pumping systems. Additionally, component configurations can be designed to supplement the transfer of energy from the viscosity handler 24 to the fluid being produced by production pump 12. As illustrated in FIG. 7, submersible motor 30 may be located above perforations 40 such that the fluid flows past submersible motor 30 before being drawn into viscosity handler 24. The heat of the motor assists in lowering the viscosity of the fluid flowing past. Alternatively or in addition to this arrangement of submersible motor 30, a supplemental heater 98 may be located within the wellbore, as illustrated in FIG. 7. An exemplary supplemental heater 98 is a resistive type heater powered via a power cable, such as power cable 56 or a separate power cable deployed downhole. Such a supplemental heater 98 may be positioned independently within wellbore 36 or it may be combined with electric submersible pumping system 28 to heat fluid as it flows past and external to the heater. Supplemental heater 98 also may be designed for deployment downstream of fluid intake 52, such that fluid is drawn through the center of the heater prior to or after entering viscosity handler 24.

In addition to the components that may be used in combination with the viscosity handler, viscosity handler 24 may use various combinations of stages to facilitate and influence fluid movement through the system. In some environments, a better initiation of fluid movement may be achieved by combining different styles of stages, e.g. at least one mixed flow stage with a plurality of radial flow stages. For example, one combination incorporates mixed flow stages as the lower two stages (as illustrated in FIG. 4) with the remainder being radial flow stages. Using mixed flow stages proximate the viscosity handler intake facilitates initial movement of the fluid particularly when the fluid is fairly viscous. Once movement of fluid is initiated, the subsequent radial stages can continue the fluid flow while imparting heat energy to the fluid. Other variations in the order of the flow stages may be used to obtain differing fluid flow efficiencies.

It will be understood that the foregoing description is of exemplary embodiments of this invention, and that the invention is not limited to the specific forms shown. For example, the viscosity handler may be utilized in conjunction with a variety of pumps for producing fluid from one location to another; the system may be utilized in wellbore or other subterranean applications; and a variety of movable components can be used to impart energy in the form of heat to the fluid flowing through the viscosity hander. These and other modifications may be made in the design and arrangement of the elements without departing from the scope of the invention as expressed in the appended claims.

What is claimed is:

1. A system for moving a viscous fluid, comprising:

a centrifugal pump;

a fluid intake; and a viscosity handler through which fluid flows from the fluid intake to the pump, the viscosity handler comprising a rotatable energy translator having a plurality of radial flow impellers, the rotatable energy translator being disposed in a fluid flow path, wherein rotation of the rotatable energy translator heats fluid as it flows along the fluid flow path prior to entering the centrifugal pump.

2. The system as recited in claim 1, wherein the viscosity handler comprises a plurality of radial flow stages and a plurality of mixed flow stages.

3. The system as recited in claim 1, wherein the radial flow impeller comprises a plurality of recirculation holes.

4. The system as recited in claim 1, further comprising a resistive element heater.

5. The system as recited in claim 1, further comprising a submersible motor to power the centrifugal pump.

6. The system as recited in claim 5, further comprising a motor protector.

7. The system as recited in claim 6, further comprising a wellbore having a wellbore casing, wherein the centrifugal pump, the fluid intake, the viscosity handler, the submersible motor and the motor protector are disposed within the wellbore casing.

8. The system as recited in claim 7, wherein the wellbore casing has a perforation disposed below the submersible motor.

9. The system as recited in claim 8, wherein the fluid intake and the pump are disposed above the submersible motor.

10. A system for producing a viscous fluid from a subterranean reservoir, comprising:

a wellbore having a wellbore casing with a perforation to permit ingress of a fluid to be produced; and an electric submersible pumping system having a submersible motor, a submersible pump to produce the fluid to a desired location, and a viscosity handler that converts kinetic energy to heat to lower the viscosity of the fluid;

wherein the viscosity handler further comprises a radial flow stage, the radial flow stage including a recirculation path.

11. The system as recited in claim 10, wherein the viscosity handler comprises a rotatable energy translator.

12. The system as recited in claim 11, wherein the rotatable energy translator comprises a plurality of rotating elements to impart energy to the fluid in the form of heat.

13. The system as recited in claim 12, wherein each rotating element comprises a radial flow impeller.

14. The system as recited in claim 13, wherein the electric submersible pumping system further comprises a motor protector.

15. The system as recited in claim 14, wherein the pump comprises a centrifugal pump.

16. The system as recited in claim 15, wherein the centrifugal pump comprises a plurality of stages, each stage having a mixed flow impeller.

17. The system as recited in claim 15, wherein the electric submersible pumping system comprises a fluid intake through which fluid is drawn by the submersible pump, the viscosity handler being positioned in the flow of fluid from the fluid intake to the submersible pump.

18. A method to facilitate production of an oil related fluid from the earth, comprising:

operating a production pump in a subterranean environment;

drawing a reservoir fluid through a pump intake; and rotating a plurality of radial flow impellers through the reservoir fluid as it passes from the fluid intake to the production pump, the plurality of radial flow impellers being rotated at a rate sufficient to lower the viscosity of the reservoir fluid and raise the efficiency of the production pump.

19. The method as recited in claim 18, further comprising producing the reservoir fluid to a desired location.

20. The method as recited in claim 19, wherein operating comprises powering the production pump with a submersible motor.

21. The method as recited in claim 18, wherein operating comprises operating a centrifugal production pump.

22. The method as recited in claim 21, further comprising placing the production pump and the pump intake within a wellbore.

23. The method as recited in claim 18, wherein operating comprises operating a centrifugal production pump having a plurality of rotatable mixed flow impellers.

24. A system to facilitate production of an oil related fluid from the earth, comprising:

means for operating a production pump in a subterranean environment;

means for drawing a reservoir fluid through a pump intake; and means for rotating a plurality of radial flow impellers through the reservoir fluid as it passes from the fluid intake to the production pump, the plurality of radial flow impellers being moved at a rate sufficient to lower the viscosity of the reservoir fluid and raise the efficiency of the production pump.

25. The system as recited in claim 24, further comprising means for placing the production pump and the pump intake within a wellbore.

26. The system as recited in claim 24, wherein the plurality of radial flow impellers comprises a plurality of recirculation holes.

27. A viscosity handler for lowering the viscosity of a wellbore fluid, comprising:

an outer housing having a fluid flow path therethrough; and an energy translator comprising a plurality of mixed flow impellers and a plurality of radial flow impellers disposed within the outer housing, wherein actuation of the moving element as fluid flows along the fluid flow path heats the fluid.

28. The viscosity handler as recited in claim 27, wherein each radial flow impeller comprises a plurality of recirculation holes.

* * * * *